United States Patent [19]

Card

[11] 4,192,445

[45] Mar. 11, 1980

[54] PACKAGING CONTAINER INCLUDING INTEGRAL CORNER LOCKS

[75] Inventor: David R. Card, Memphis, Tenn.

[73] Assignee: Champion International Corporation, Stamford, Conn.

[21] Appl. No.: 6,991

[22] Filed: Jan. 29, 1979

[51] Int. Cl.[2] ..... B65D 5/30

[52] U.S. Cl. ..... 229/35; 229/36

[58] Field of Search ..... 229/35, 36

[56] References Cited

U.S. PATENT DOCUMENTS

| | | | |
|---|---|---|---|
| 1,150,491 | 8/1915 | Bingaman | 229/35 |
| 2,065,150 | 12/1936 | O'Brien | 229/35 X |
| 2,193,925 | 3/1940 | Huye | 229/35 X |
| 2,553,870 | 5/1951 | Samsing | 229/35 |
| 3,067,924 | 12/1962 | Baker et al. | 229/35 |
| 3,069,061 | 12/1962 | Dion | 229/35 |
| 4,082,215 | 4/1978 | Eichenauer | 229/36 |

FOREIGN PATENT DOCUMENTS

| | | | |
|---|---|---|---|
| 220069 | 3/1962 | Austria | 229/36 |
| 737685 | 9/1955 | United Kingdom | 229/35 |
| 1211848 | 11/1970 | United Kingdom | 229/35 |

*Primary Examiner*—Davis T. Moorhead

*Attorney, Agent, or Firm*—Evelyn M. Sommer

[57] ABSTRACT

A rectangularly shaped container having opposed end walls, opposed side walls, a bottom wall and spaced apart top wall sections forming a display opening therein is maintained in a rigid erected state by lock forming structure interconnecting various walls of the container at the corners of the latter. Each end of the top walls is provided with an integrally formed foldable flap that includes a tab which is inserted into a corresponding diagonal slot in the side walls as the container is folded during set-up thereof to securely hold the several walls in fixed relationship to each other without the need of gluing, taping or stapling. The container is formed from a blank comprising a single sheet of cardboard or the like and is suitable for shipping and displaying articles contained therein.

6 Claims, 7 Drawing Figures

Fig. 1.
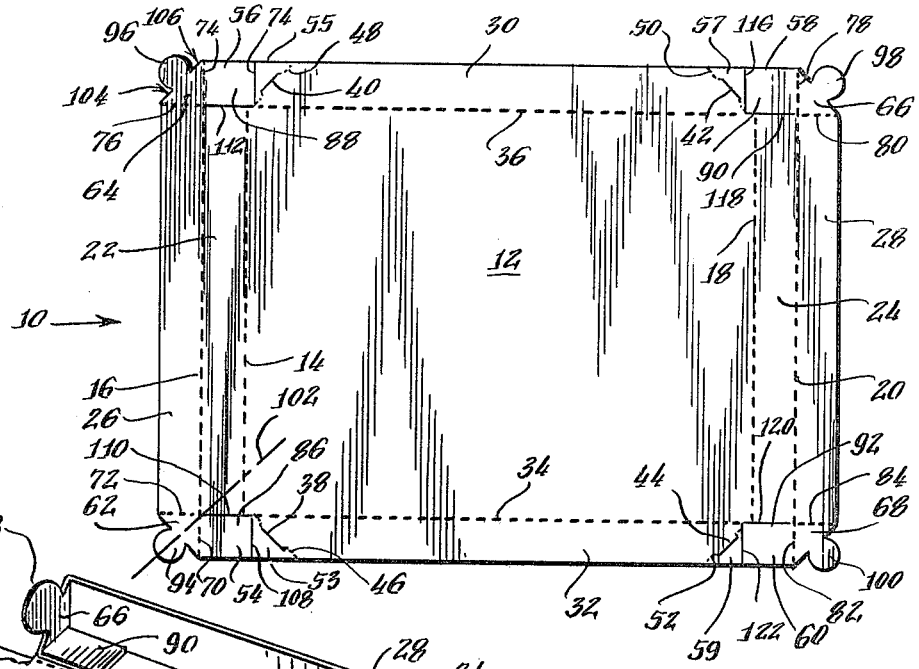
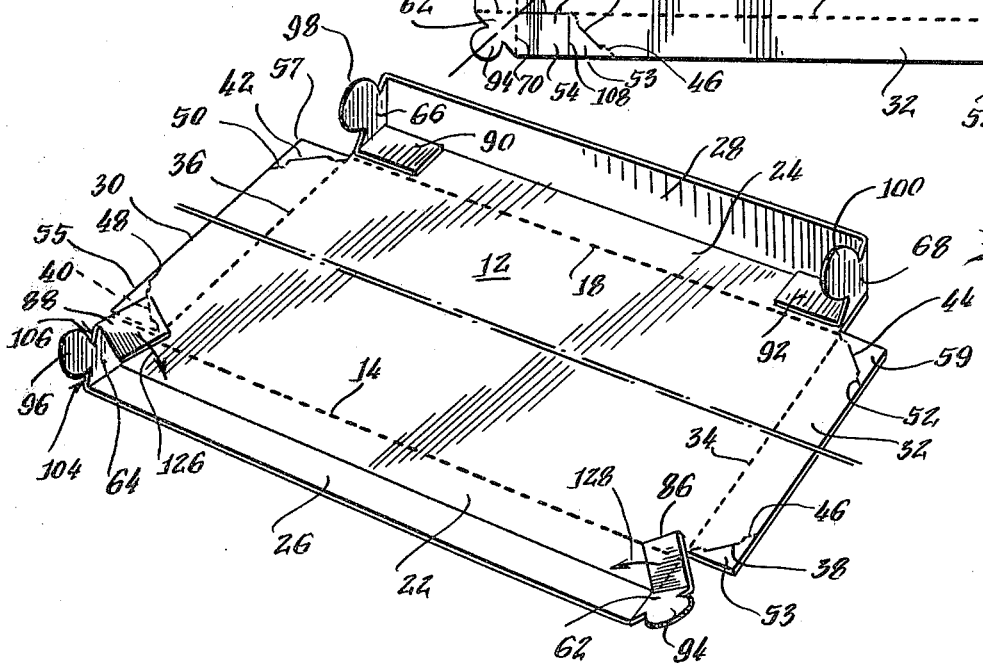
Fig. 2.
Fig. 3.
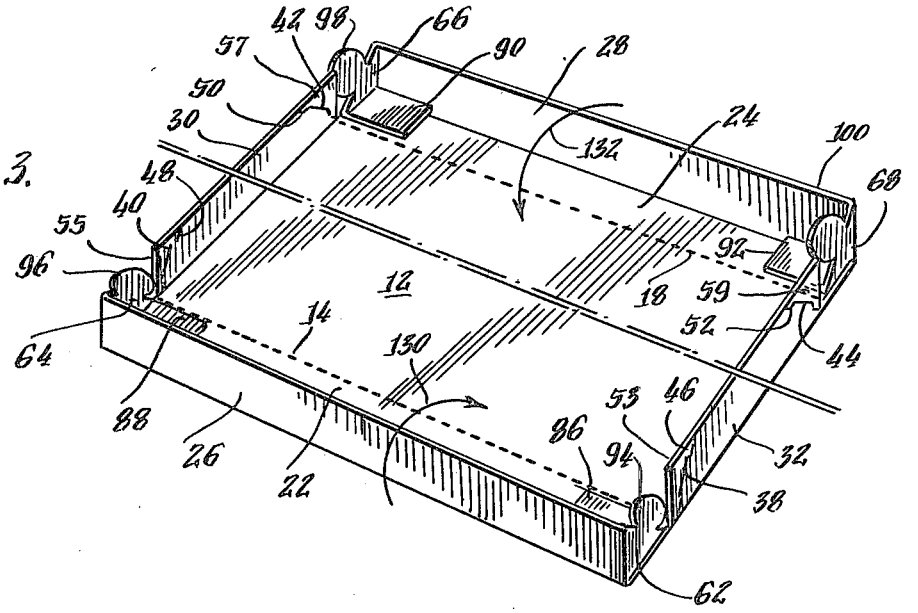

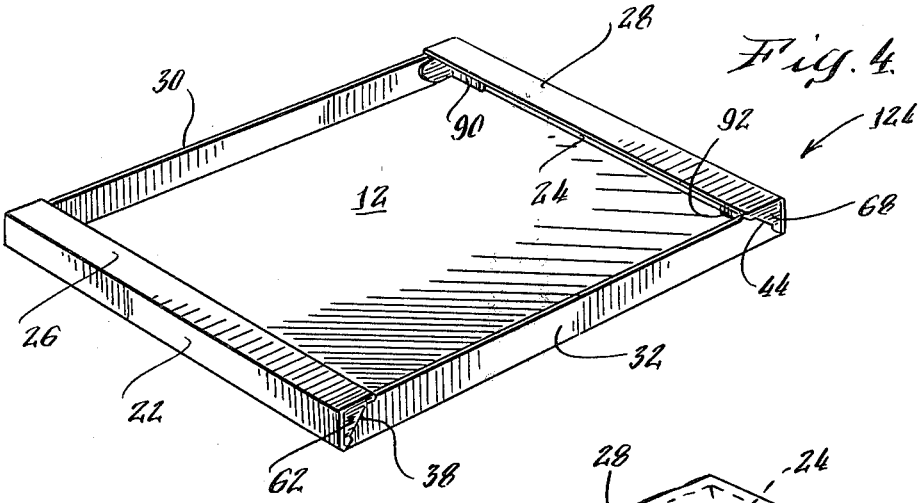
Fig. 4.
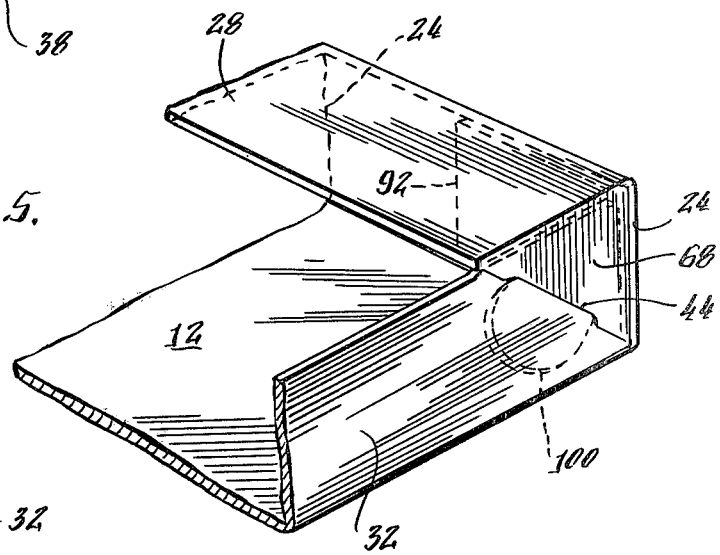
Fig. 5.
Fig. 6.
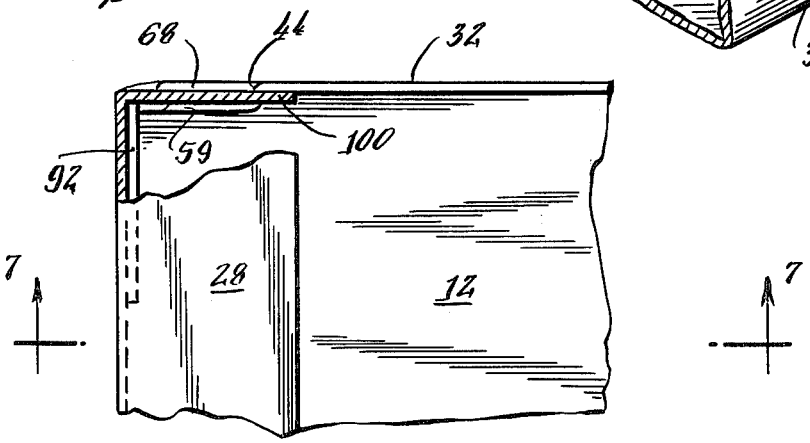
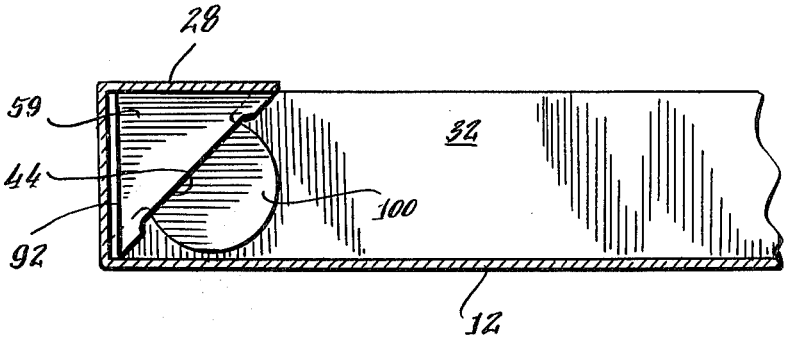
Fig. 7.

PACKAGING CONTAINER INCLUDING INTEGRAL CORNER LOCKS

TECHNICAL FIELD

This invention generally relates to the packaging container art, and deals more particularly with a tray-like container formed from a blank which includes a novel corner locking structure which maintains the container in its erected condition.

BACKGROUND OF THE INVENTION

Prior to the present invention, packaging containers suited for shipping and displaying relatively small, light weight products required the use of glue, tape or staples for erecting the container and closing or sealing the latter after the product had been placed therewithin. Consequently, known prior art containers are less than satisfactory from an assembly standpoint as a result of the additional labor and materials which are required in setting-up (erecting) and sealing the same.

SUMMARY OF THE INVENTION

The present invention provides a container having corner lock structure which securely maintains the container in an erected, sealed condition without the need for gluing, stapling, taping or the like. A rectangularly shaped, tray-like container includes opposed end walls, opposed side walls, a bottom wall, and a pair of spaced apart top walls, which latter walls form a display window opening in the top of the container for displaying a product therein. The container is formed from a blank comprising a single sheet of paper. Each end of the top walls is provided with an integrally formed, foldable flap that includes a tab which is inserted into a diagonal slot in each end of the side walls during folding and set-up of the container to securely lock the corners of the container together and thereby maintain the latter in a rigid, set-up condition. A product within the container may be simply removed therefrom by withdrawing the tabs on one end of the container from their associated slots and unfolding the corresponding top and end walls to open one end of the container.

DESCRIPTION OF THE DRAWINGS

In the drawings, which form a part of the specification and are to read in conjunction therewith, and in which like reference numerals are employed to indicate like parts in the various views:

FIG. 1 is a top plan view of a blank comprising a single sheet of paper stock for forming the container of the present invention;

FIGS. 2 and 3 are perspective views of the blank of FIG. 1, depicting the steps for folding the blank to form the container and showing the latter in partially erected states;

FIG. 4 is a perspective view of the erected container which forms the present invention, but empty of a product;

FIG. 5 is a partial, detailed perspective view of one corner of the container of FIG. 4, hidden parts being indicated in the phantom;

FIG. 6 is a partial, top view of one corner of the container of FIG. 5, parts being broken away in section for clarity; and FIG. 7 is a partial, sectional view taken along the line 7—7 in FIG. 6.

DETAILED DESCRIPTION OF THE INVENTION

Referring first to FIG. 1, a blank generally designated by the numeral 10 comprises a single sheet of relatively rigid paper stock such as cardboard. The blank 10 includes a rectangular center panel forming a bottom wall 12 and a pair of relatively narrow, rectangular strips connected along mutual co-extensive edges of the bottom wall 12 by scored fold lines 14, 16, 18 and 20, which strips provide end walls 22 and 24 as well as top walls 26 and 28. The other two opposing edges of bottom wall 12 have connected thereto corresponding co-extensive edges of the rectangularly shaped strips forming side walls 30 and 32 by respectively associated scored fold lines 34 and 36. Each extremity of the side walls 30, 32 is provided with an elongate, diagonal slot 38, 40, 42 and 44 respectively therethrough having one edge thereof aligned with bending lines 46, 48, 50 and 52 each of which define triangularly shaped ears 53, 55, 57 and 59 at the corresponding ends of the side walls 30 and 32 adjacent the fold lines 34 and 36. Each corner of the blank 10 includes a flap 54, 56, 58 and 60 which each respectively comprise a generally triangularly shaped base section 62, 64, 66 and 68 having two adjacent edges or "legs" thereof connected by respective fold lines 70, 72, 74, 76, 78, 80, 82 and 84 to adjacent co-extensive edges of top walls 26 and 28, side walls 30 and 32, and rectangularly shaped tuck flap portions 86, 88, 90 and 92. The flaps 54-60 each further comprise respective tab sections 94, 96, 98 and 100 along the remaining edge or side thereof. Tab sections 94-100 are each of a generally circularly shaped configuration and include a pair of arcuate, opposing edges which are symmetric with respect to each other about a reference axis as at 102 passing through the midpoint of the associated leg of the corresponding base section and through the apex of such base section opposite said latter mentioned leg. The legs of the base sections 62-68 having the corresponding tab section 94-100 extending therefrom include a pair of straight edges as at 104 and 106 on opposite sides of the associated tab section such as tab section 96. Tuck flap portions 86-92 each have two adjacent edges thereof separated from respectively corresponding ends of side walls 30 and 32, and end walls 24 and 24 by cut lines 108, 110, 112, 114, 116, 118, 120 and 122.

Referring also now to FIGS. 2, 3 and 4, the blank 10 may be erected into the rectangularly shaped packaging container generally indicated by the numeral 124 by several simple folding steps. The first step in setting-up the container 124 consists of pivoting each of the flaps 54-60 90 degrees inwardly about the corresponding fold lines 72, 76, 80 and 84 to an upright position; simultaneously, each of the tuck flap portions 86-92 are pivoted 90 degrees in the direction of arrows 126 and 128 until such flaps are essentially vertically aligned with the corresponding fold lines 16 and 20. Top walls 26 and 28 are then pivoted along with tuck flap portions 86-92, 90 degrees inwardly toward each other about the associated fold lines 16 and 20 to an upright position, at which point the planar surface areas of one side of the tuck flaps 86-92 are in abutment with the interior planar surfaces of the corresponding end walls 22 and 24.

The next step in the set-up procedure consists of folding each of the side walls 30 and 32 90 degrees inwardly toward each other about respectively associated fold lines 34 and 36 to an upright position as shown in FIG. 3. The end walls 22 and 24, and top walls 26 and 28, along with flaps 54-60 are then pivoted inwardly toward each other in the direction of the arrows 130 and 132 about the corresponding fold lines 14 and 18; simultaneously, the ears 53-59 are bent slightly inward along bending lines 46-52 to allow the tab sections 94-100 to be inserted from a position outside the side walls 30 and 32 through the respectively associated slots 38-44 into the interior of the container 124. At this point the container is fully set-up, however, in actual practice, one end of the container 124 will be set-up first after which a product will be inserted into the container, followed by set-up of the other end thereof.

With reference now also to FIGS. 5, 6 and 7, the flaps 54-60 in combination with the slots 38-44 form a locking structure which securely hold the corners of the container in their set-up condition, thereby maintaining the container 124 in its erected position. The width of tab sections 94-100 is preferably marginally wider than the length of the corresponding slots 38-44 to assure a tight slip fit therebetween. As best seen in FIGS. 5 and 7, each of the slots such as slot 44 extend diagonally from lower portions of the associated side wall, such as side wall 32, in a direction away from the adjacent end wall, such as end wall 24, toward upper portions of such side wall. The edges on opposite sides of each of the tab sections, such as edges 104 and 106, limit the travel of the associated tab section 94-100 into the corresponding slot 38-44.

A significant feature of the invention resides in the fact that the flaps 54-60 are connected to the top walls 26 and 28; consequently, forces imposed by a product packaged within the container on the top walls 26 and 28 urging the tab sections 94-100 upwardly cause the latter to engage the upper end of the slots 38-44, since the corner locking structure can be released only by shifting the tab sections 94-100 diagonally upward, perpendicular to the longitudinal axis of the slots 38-44.

By virtue of the substantial spacing between the top walls 26 and 28 which provides a substantial window opening through which the product packaged therein may be viewed, the container is particularly well adapted for displaying as well as shipping packaged products. Heat shrinkable, clear plastic material may be wrapped around the container 124 to seal the contents thereof.

From the foregoing, it will be observed that the present invention provides a particularly simple packaging container having a substantial display window opening therein, which includes novel corner lock structure that maintains the container in an erected condition without the need for gluing, stapling or taping. It is recognized, of course, that those skilled in the art may make various modifications or additions to the preferred embodiment chosen to illustrate the invention without departing from the gist and essence of the present contribution to the art. Accordingly, it is to be understood that the projection sought and to be afforded hereby should be deemed to extend to the subject matter claimed and all equivalents thereof fairly within the scope of the invention.

What is claimed is:

1. A packaging container including:

a pair of opposed end walls, a pair of opposed side walls, a rectangularly shaped bottom wall and a pair of spaced apart top walls connected together to form a rectangularly shaped enclosure, said end walls, said side walls and said top walls being interconnected adjacent each corner of said bottom wall by corner locking structure including a flap joined to each end of said top walls extending perpendicular to the latter and generally coplanar with the corresponding side walls, said locking structure further including a slot in each of said side walls configured to receive at least a portion of the corresponding flap therethrough, each of said slots extending diagonally from lower portions of the associated side wall in a direction away from the adjacent end wall toward upper portions of said associated side wall, each of said flaps including a tab section passing through the corresponding one of said slots and disposed within said enclosure, a triangularly shaped base section extending between the corresponding top wall and end wall and disposed exterior of said enclosure, and a tuck flap portion having one edge thereof joined along one leg of said triangular base section thereof, said tuck flap portion being disposed within said enclosure in side-by-side abutting relationship to the corresponding end wall.

2. The container of claim 1, wherein:

said tab section is disposed along another leg of said base section, there being straight edges along said another leg on opposite sides of said tab section engagable with said upper and lower portions of the corresponding side wall to limit the travel of said tab through said slot, said tab section including opposing arcuate edges slidably engagable with edges of said latter mentioned side wall defining said slot in the latter.

3. The container of claim 2, wherein:

said bottom wall, said side walls, said end walls and said top walls are each generally rectangular in shape, and said flaps are formed integral with each of said top walls, on opposite ends of the latter.

4. A blank comprising a single sheet of paper stock for forming the receptacle of claim 1.

5. A blank comprising a single sheet of paper stock for forming the receptacle of claim 2.

6. A blank comprising a single sheet of paper stock for forming the receptacle of claim 3.

* * * * *